US005304094A

United States Patent [19]

MacCracken

[11] Patent Number: 5,304,094

[45] Date of Patent: Apr. 19, 1994

[54] METHOD OF MIXING COLD INTRODUCED AIR WITH WARMER ROOM AIR

[76] Inventor: Calvin D. MacCracken, 325 Morrow Rd., Englewood, N.J. 07631

[21] Appl. No.: 917,420

[22] Filed: Jul. 23, 1992

[51] Int. Cl.[5] ..... F24F 7/06

[52] U.S. Cl. ..... 454/258; 236/49.1; 454/906

[58] Field of Search ..... 236/49.1; 454/258, 284, 454/305, 323, 334, 906

[56] References Cited

U.S. PATENT DOCUMENTS

| | | | |
|---|---|---|---|
| 1,680,472 | 8/1928 | Nuccio | 454/305 |
| 2,182,690 | 12/1939 | Cole | 454/305 X |
| 3,759,157 | 9/1973 | Lärkfeldt et al. | 454/305 |
| 3,836,073 | 9/1974 | Evans et al. | 454/258 X |
| 4,537,347 | 8/1985 | Noll et al. | 454/258 X |

FOREIGN PATENT DOCUMENTS

| | | | |
|---|---|---|---|
| 113247 | 5/1988 | Japan | 454/315 |
| 885731 | 11/1981 | U.S.S.R. | 454/284 |
| 8741 | of 1909 | United Kingdom | 454/284 |

*Primary Examiner*—Harold Joyce
*Attorney, Agent, or Firm*—Charles J. Brown

[57] ABSTRACT

A method of mixing introduced relatively cold air with warmer air in a room which comprises directing a stream of high-velocity very cool air from jet orifices in the room wall at adult eye level upwardly along the wall to the ceiling, thus thoroughly mixing the introduced and room air and reducing their differential in temperature and velocity virtually to zero by the time the air stream reaches the ceiling.

3 Claims, 2 Drawing Sheets

METHOD OF MIXING COLD INTRODUCED AIR WITH WARMER ROOM AIR

BACKGROUND OF THE INVENTION

As cold air is introduced into room air in an air conditioning system it is important to mix them thoroughly to achieve uniform floor to ceiling temperatures. In commercial applications and many residential applications as well introduced air is mixed with the ambient room air by utilizing difusers or air distributors from which the introduced air passes to the room through grilles or slots. Air conditioning systems in which the introduced air volume is made variable by valving means commonly employ a fan-powered box in which air is pulled from the room to maintain needed air velocity and performance in the difuser when only partial cooling is required. Alternatively, induction without a fan in the box has also been used.

Coolness storage by means of ice banks made it possible to lower substantially the temperature of duct air to as much as 43° to 45° F. and this permitted primary fan motors to be substantially reduced in size and energy consumption. It was discovered, however, that fan-powered boxes were necessary to avoid drafts and unacceptable variations in room temperature and after some experience it was concluded that multiple fans in the boxes were more than cancelling the energy savings of the fewer large primary fan motors.

In contrast to the use of multiple difusers and fan-powered boxes in commercial office spaces, it was the practice several decades ago in residential air conditioning systems that cooler introduced air could be mixed with warmer room air by means of high-velocity jets blowing downwardly from jet orifices in the ceiling of a residential room. With these high-velocity air jets the temperature of the emitted air stream would drop close to ambient very quickly and thus eliminate the need for conventional distribution systems. The high-velocity jets were commonly located in the ceiling at the corners of the residential room so that the emitted air stream would be directed into essentially unoccupied spaces.

Variable air volume was achieved in those residential high-velocity jet installations by varying the jet orifice size, and this was done by expansion and contraction of a wax capsule exposed to ambient room air, as taught for example in U.S. Pat. No. 3,235,178. The air streams from the jet orifices had a velocity of approximately 2,000 feet per minute and lost that velocity rapidly as the streams and mixed with ambient air. The temperature and velocity differential was reduced almost by half in the first four orifice diameters away from the orifice and reached zero at twenty orifice diameters away from the orifice. In an eight foot high residential room with two inch diameter orifice the temperature and velocity delta were virtually zero by the time the introduced air flow reached floor level.

Down-flow high-velocity mixing of this type was not acceptable in large commercial rooms because unoccupied corners or other spaces were not normally available and jets blowing air streams downwardly on occupants caused unacceptable drafts. In addition conventional commercial ceilings of removable suspended panels did not lend themselves to ceiling outlets.

SUMMARY OF THE INVENTION

The invention provides a method of mixing introduced relatively cold air with warmer ambient air in a room. First, introduced air is conveyed through a duct within a wall of the room. The introduced air is then passed from the duct through silencer means. Next the introduced air is directed from the silencer means into the room through at least one jet orifice on the room wall approximately at adult eye level in a high-velocity stream in excess of approximately 2,000 feet per minute substantially upwardly along but slightly away from the wall toward the ceiling of the room. The orifice size and hence the volume of air introduced into the room is varied in response to changes in ambient room temperature.

In a preferred form of the method the introduced air is conveyed through the duct at a velocity of at least approximately 1,000 feet per minute and it leaves the orifice as much as 30° F. colder than the ambient air in the room. The silencer means may be a soft-lined silencer box. The varying of the orifice size may be from expansion and contraction of a wax capsule exposed to a current of ambient room air, and that current may be from aspiration by a venturi ejector through which a portion of introduced air is directed after leaving the silencer means and which exits into the interior of the wall. The introduced air may be directed into the room through a plurality of jet orifices and the orifice size of only some of the jet orifices may be varied to vary the volume of air introduced into the room.

The distance when the jet air stream velocity slows to an acceptable rate of say 25 to 30 feet per minute depends upon the orifice diameter. A 1.4 inch diameter jet orifice emitting a 2,000 feet per minute stream will require only about 4 feet to reach that slower speed. Thus by the time the jet air stream starting at about eye level reaches a typical 8 foot ceiling it has slowed to only a slight current, the temperature differential with ambient room air has reduced to only 1° or 2° F. and thorough mixing has been accomplished.

As a consequence of this method it is possible to recirculate a relatively large amount of air in a room and the rapid achievement of a low delta-T means that careful distribution of incoming air is unnecessary. No mixing, such as fan-powered or induction boxes, is required before the introduced air enters the room. Difusers are eliminated. Exceptionally high initial temperature differentials between the cold introduced air and the warmer room air are made possible.

DESCRIPTION OF PREFERRED EMBODIMENT

Figure 1:
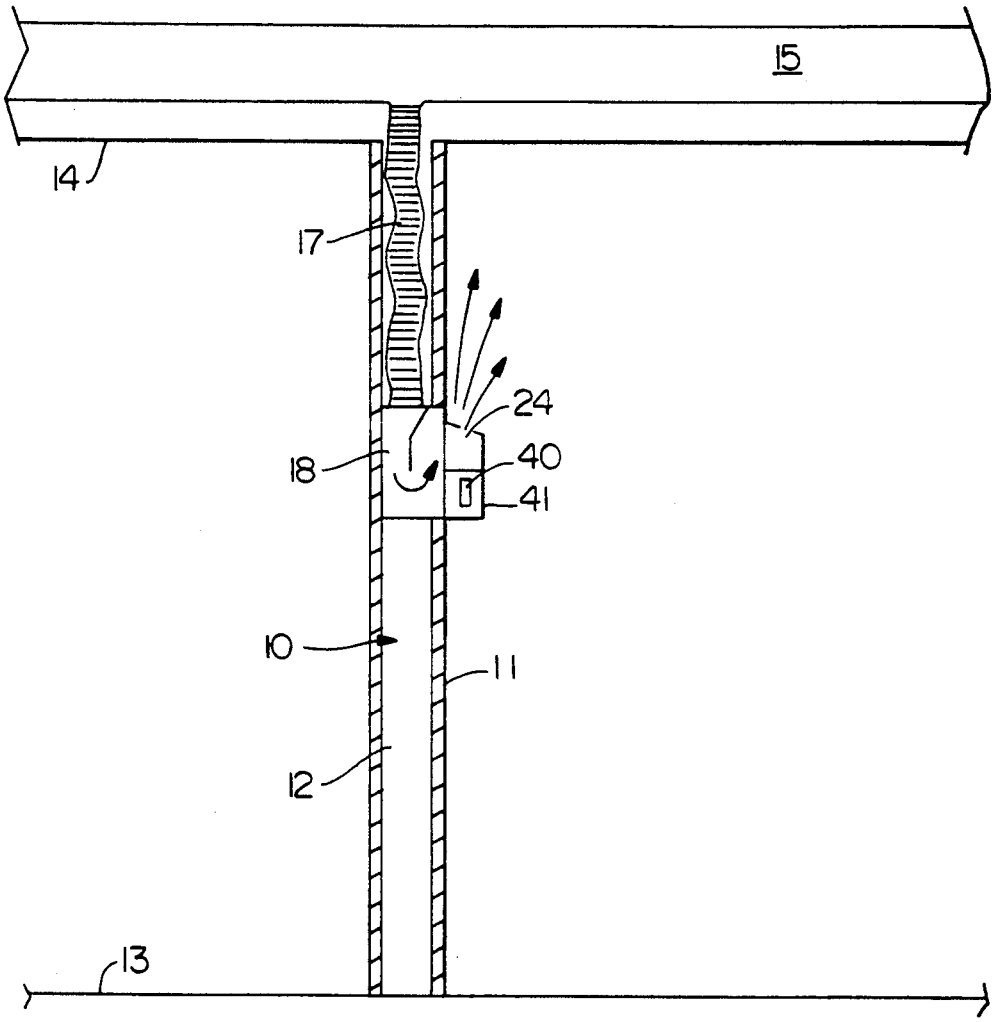
FIG. 1 is a schematic illustration of apparatus for practicing the method of the invention.

Referring first to FIG. 1 rooms in a commercial facility are divided by walls 10 faced with wallboard 11 and defining interior spaces 12 between studs. The walls 10 extend from a floor 13 to a ceiling 14.

Above the ceiling 14 a conventional cold air manifold 15 is provided. It may be of sheet metal and of rectangular cross section and it may be thermally insulated. Introduced air within the manifold 15 is as much as 30° F. colder than ambient air in the room, typically at a temperature of 45° F. Connected to the manifold 15 are a series of individual flexible ducts 17 of relatively small diameter, one of which is shown in the drawing.

Figure 3:
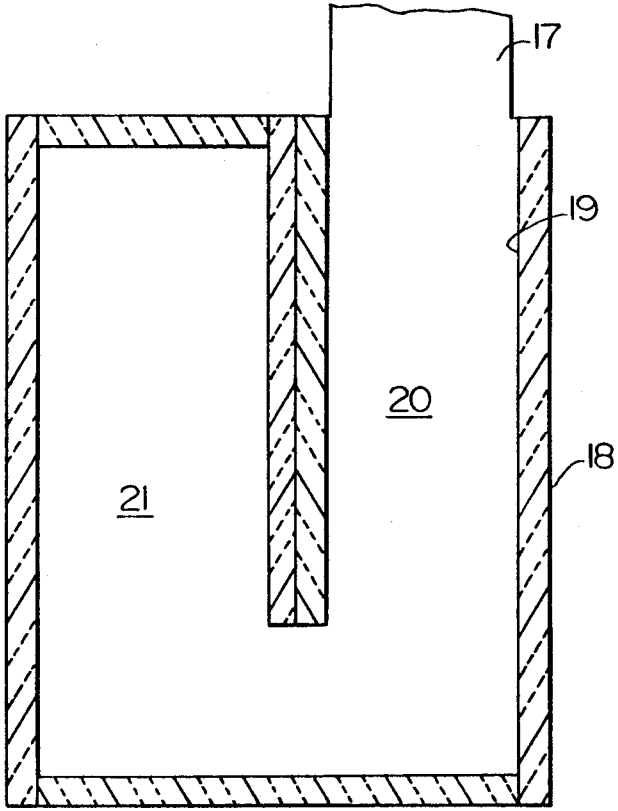
FIG. 3 is a section taken along the line 3—3 of FIG. 2.
Figure 2:
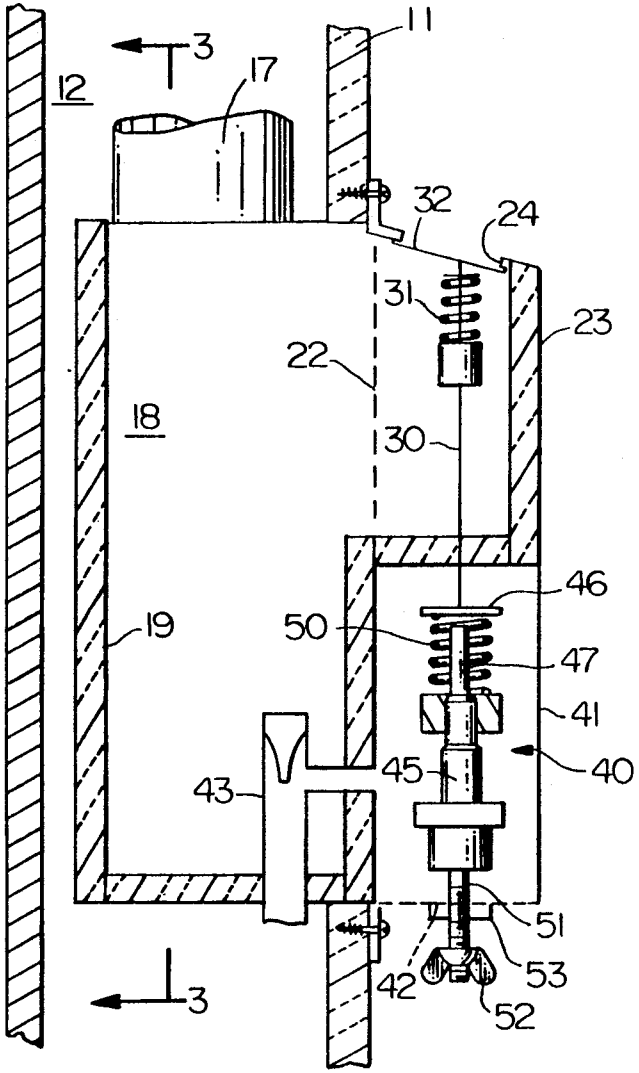
FIG. 2 is an enlarged fragmentary section of the eye level installation in the wall of the room for emitting the jet air stream in accordance with the method of the invention.

Referring now to FIGS. 2 and 3 each duct 17 communicates with a rectangular silencer box 18 into which the air enters at a velocity of about 1,000 feet per minute and which is lined with fiberglass 19 to reduce transmission of sound from the high-velocity air. The introduced air proceeds downwardly through a passageway 20 and then up through a passageway 21 to a side opening 22 into a jet box 23. From the jet box 23 the air stream passes through an adjustable orifice 24 at a velocity of about 2,000 feet per minute and is directed upwardly and slightly at an angle from the wall surface 11 towards the ceiling of the room as shown by the dotted lines in FIG. 1. As described previously the orifices 24 are at approximately the eye level of an adult standing in the room. As the emitted air stream proceeds to the ceiling its velocity is reduced virtually to zero and so too is the difference in temperature between the air stream and the ambient air of the room.

Some, but not all, of the several jet orifices 24 are adjustable and the means for achieving this is shown in FIG. 2. A tension cable 30 when pulled down against a compression spring 31 lowers a closure disk 32 to open an annulus around the orifice 24 and allow more introduced air to escape into the room. When tension is released on the cable 30 the compression spring 31 moves the closure disk 32 upwardly to reduce that annular aperture and the amount of air entering through that orifice. There may be a central hole in the closure disk 32 which is always open to deliver a small amount of stabilizing air to the room.

The cable 30 is alternately tensioned and slackened by means of a temperature sensing device 40 of the kind described in detail in the aforementioned U.S. Pat. No. 3,235,178 with reference particularly to FIGS. 6 to 8 described in column 10 thereof. The temperature sensing device 40 is enclosed within its own housing 41 having an air entry grille 42 in its bottom into which room air can be drawn. This current of room air is achieved by aspiration from a venturi ejector 43 which receives a portion of the pressurized high-velocity air passing through the silencer box 18 and discharges that portion of air into the space 12 within the wall 10. The current of aspirated air passes over a wax capsule 45 which expands and contracts in response to changes in temperature of the room air. A plate 46 is secured to the top of a piston 47 and the lower end of the cable 30 is anchored to the plate 46. A compression spring 50 biases the plate 46 in an upward direction. An increase in temperature of room air aspirated over the wax capsule 45 causes the piston 46 to move upwardly and slacken the cable 30 thereby reducing the effective size of the orifice 24. Conversely a decrease in room air temperature causes the piston 47 to move downwardly and increase the opening of the orifice 24.

To permit selective manual opening or closing of the jet orifice 24 independent of room temperature changes the temperature sensing device 40 may be mounted upon a screw 51 which can be turned by an exterior wing nut 52 in a bushing 53 mounted in the grille 42 to raise or lower the sensing device 40 and thus tension or slacken the cable 30.

In the practice of the method of the invention introduced air is conveyed into the flexible duct 17 at a velocity of approximately 1,000 feet per minute. The air then passes from the duct 17 through the soft-lined silencer box 18. The introduced air is then directed from the silencer box 18 into the room at a temperature about 30° F. cooler than the ambient air in the room through the plurality of jet orifices 24 on the room wall approximately at adult eye level in high-velocity streams in excess of approximately 2,000 feet per minute substantially upwardly along but slightly away from the wall toward the ceiling of the room. The orifice size of some but not all of the orifices 24, and hence the volume of air introduced into the room, are varied in response to changes in ambient room temperature by expansion and contraction of the wax capsule 40 exposed to a current of ambient room air aspirated to the wax capsule by the venturi ejector 43 through which a portion of introduced air is directed from the silencer box 18 and exits into the interior of the wall.

The scope of the invention should be determined by the following claims rather than by the foregoing description of preferred embodiment.

I claim:

1. A method of mixing introduced relatively cold air with warmer ambient air in a room which comprises a) conveying the introduced air into a flexible duct of circular cross section within a wall of the room at a velocity of at least approximately 1,000 feet per minute, b) passing the introduced air from the duct through a soft-lined silencer box, c) directing the introduced air from the silencer box into the room at a temperature about 30° F. cooler than the ambient air in the room through a plurality of jet orifices on the room wall approximately at adult eye level in a high-velocity stream in excess of approximately 2,000 feet per minute substantially upwardly along but slightly away from the wall toward the ceiling of the room, and d) varying the orifice size of some but not all of the jet orifices and hence the volume of air introduced into the room in response to changes in ambient room temperature by expansion and contraction of a wax capsule exposed to a current of ambient room air aspirated to the wax capsule by a venturi ejector through which a portion of introduced air is directed after leaving the silencer box and which exits into the interior of the wall.

2. A method of mixing introduces relatively cold air with warmer ambient air in a room which comprises a) conveying the introduced air through a duct within a wall of the room, b) passing the introduced air from the duct through silencer means, c) directing the introduced air from the silencer means into the room through at least one jet orifice on the room wall approximately at adult eye level in a high-velocity stream in excess of approximately 2,000 feet per minute substantially upwardly along but slightly away from the wall toward the ceiling of the room, and d) varying the orifice size and hence the volume of air introduced into the room to cause desired changes in ambient room temperature, e) the varying of the orifice size being a result of expansion and contraction of a wax capsule exposed to a current of ambient room air, f) the current of ambient room air being aspirated to the wax capsule by a venturi ejector through which a portion of introduced air is directed after leaving the silencer means which introduced air then passes into the interior of the wall after leaving the ejector.

3. A method of mixing introduced relatively cold air with warmer ambient air in a room which comprises a) conveying the introduced air through a duct within a wall of the room at a velocity of at least approximately 1,000 feet per minute, b) passing the introduced air from the duct through silencer means, c) directing the introduced air from the silencer means into the room at a temperature at least about 30° F. colder than the air in the room through at least one jet orifice on the room wall approximately at adult eye level in a high-velocity stream in excess of approximately 2,000 feet per minute substantially upwardly along but slightly away from the wall toward the ceiling of the room, d) said air stream after leaving the orifice then mixing with room air and slowing until after about four feet of travel from the orifice the air stream velocity reduces to a maximum of about thirty feet per minute and the temperature differential between the air stream and room air reduces to a maximum of about 2° F., and e) varying the volume of air introduced into the room to cause desired changes in ambient room temperature.

* * * * *